US005687681A

United States Patent [19]

Hara

[11] Patent Number: 5,687,681

[45] Date of Patent: Nov. 18, 1997

[54] PHASE CHANGING MECHANISM FOR CAMSHAFT OF INTERNAL COMBUSTION ENGINE

[75] Inventor: Seinosuke Hara, Atsugi, Japan

[73] Assignee: Unisia Jecs Corporation, Atsugi, Japan

[21] Appl. No.: 734,022

[22] Filed: Oct. 18, 1996

[30] Foreign Application Priority Data

| | | | |
|---|---|---|---|
| Oct. 18, 1995 | [JP] | Japan | 7-269596 |
| Nov. 15, 1995 | [JP] | Japan | 7-295869 |
| Jun. 6, 1996 | [JP] | Japan | 8-143806 |

[51] Int. Cl.[6] ..... F01L 13/00

[52] U.S. Cl. ..... 123/90.17; 123/90.31; 123/90.34; 74/568 R; 464/2

[58] Field of Search ..... 123/90.15, 90.17, 123/90.31, 90.33, 90.34; 74/567, 568 R; 464/1, 2, 160

[56] References Cited

U.S. PATENT DOCUMENTS

| | | | |
|---|---|---|---|
| 5,161,493 | 11/1992 | Ma | 123/90.17 |
| 5,333,579 | 8/1994 | Hara et al. | 123/90.17 |
| 5,349,929 | 9/1994 | Shimizu et al. | 123/90.17 |
| 5,361,736 | 11/1994 | Phoenix et al. | 123/90.17 |
| 5,365,896 | 11/1994 | Hara et al. | 123/90.17 |
| 5,494,009 | 2/1996 | Yamada et al. | 123/90.17 |
| 5,501,186 | 3/1996 | Hara et al. | 123/90.16 |
| 5,553,573 | 9/1996 | Hara et al. | 123/90.15 |
| 5,557,983 | 9/1996 | Hara et al. | 123/90.17 |
| 5,592,908 | 1/1997 | Hara et al. | 123/90.17 |

FOREIGN PATENT DOCUMENTS

| | | |
|---|---|---|
| 43 20 126 | 12/1993 | Germany . |
| 7-34831 | 2/1995 | Japan . |
| 7-42516 | 2/1995 | Japan . |
| 1 311 562 | 3/1973 | United Kingdom . |
| 2 267 949 | 12/1993 | United Kingdom . |
| 2 268 246 | 1/1994 | United Kingdom . |
| 2 282 465 | 4/1995 | United Kingdom . |
| 2 292 233 | 2/1996 | United Kingdom . |

*Primary Examiner*—Weilun Lo
*Attorney, Agent, or Firm*—Foley & Lardner

[57] ABSTRACT

A phase changing mechanism is disclosed which is applicable to a valve gear of a dual overhead camshaft internal combustion engine. The mechanism comprises a driving shaft, a cam rotatable relative to the driving shaft, a drive member fixed to the driving shaft, a driven member integral with the cam, a support, an intermediate member rotatablly supported in an eccentric circular cam integral with the support, a first coupling coupling the drive member with the intermediate member at a first position spaced from an axis of the driving shaft, and a second coupling coupling the driven member with the intermediate member at a second position angularly spaced from the first position with respect to the shaft axis. The first coupling has a movable connection with the intermediate member to permit variation in a distance of the first position from an axis of rotation of the intermediate member during operation. The second coupling has a movable connection with the intermediate member to permit variation in a distance of the second position from the axis of rotation of the intermediate member during operation. The support is rotatably supported by at least one of the drive and driven members.

24 Claims, 14 Drawing Sheets

PHASE CHANGING MECHANISM FOR CAMSHAFT OF INTERNAL COMBUSTION ENGINE

BACKGROUND OF THE INVENTION

1. Field of the Invention

The present invention relates to a phase changing mechanism for varying the phase of a driven member relative to a drive member. The invention is used for the camshaft of an internal combustion engine for varying valve opening duration of a cylinder valve. such as an intake or exhaust valve in a dual overhead camshaft internal combustion engine.

2. Description of the Prior Art

U.S. Pat. No. 5,365,896, equivalent to GB-B 2 268 246 or DE-A 43 20 126, discloses a phase changing mechanism for moving or varying the phase of a plurality of hollow cams relative to its driving shaft. This known mechanism comprises a plurality of drive members rotatable with the driving shaft, a plurality of driven members rotatable with the plurality of hollow cams and a plurality of intermediate members rotatable within a plurality of supports, respectively. The driving shaft extends through central holes in the intermediate members. Each of the central holes is dimensioned to allow limited movement of one of the supports to vary eccentricity of an axis of the intermediate members with respect to the shaft axis. The hollow cams are coaxial with the driving shaft and rotatable relative thereto. Each of the drive members is coupled with the adjacent one of the intermediate members by a first coupling at a first position spaced from the shaft axis. Each of the driven members is coupled with the adjacent one of the intermediate members by a second coupling at a second position angularly spaced from the first position with respect to the shaft axis. Each of the first and second couplings has a movable connection with the adjacent one of the intermediate members to permit variation in its distance from the axis of the intermediate member during operation. To move the supports within a plane perpendicular to the shaft axis, each of the supports is supported, on one hand, by a pivot shaft fixed to the adjacent one of beams transvesely extending between two parallel rails of a framing structure, and, on the other hand, by a control rod, which is also supported by the beams. In installing this known mechanism on the engine cylinder head, it is mounted to the framing structure and the assembly including the framing structure is placed on the cylinder head and bolts are tightened to fixedly secure the framing structure to the cylinder head. In operation, as the driving shaft drives each of the plurality of hollow cams through the first coupling, the intermediate member rotatably supported by the support and the second coupling, the beam of the framing structure bears all of load which the support is subjected. Since force is transmitted from the drive member to the driven member through the movable connections of the couplings which are radially distant from the shaft axis, the driving shaft is subject to bending stress.

It would be therefore be desirable to improve the phase changing mechanism of the above kind such that the bulky expensive framing structure is not required for its installation on the engine cylinder head and the bending stress which the driving shaft is subjected to is eliminated or at least minimized.

SUMMARY OF THE INVENTION

According to the present invention, there is provided a phase changing mechanism comprising:

a driving shaft rotatable about a shaft axis;

a cam rotatable relative to said driving shaft;

a drive member rotatable with said driving shaft;

a driven member rotatable with said cam;

a support;

an intermediate member supported in said support for rotation about an axis thereof;

a first coupling coupling said drive member with said intermediate member at a first position spaced from said shaft axis;

a second coupling coupling said driven member with said intermediate member at a second position angularly spaced from said first position with respect to said shaft axis;

said first coupling having a movable connection with said intermediate member to permit variation in a distance of said first position from said axis of rotation of said intermediate member during operation, said second coupling having a movable connection with said intermediate member to permit variation in a distance of said second position from said axis of rotation of said intermediate member during operation, an eccentric circular cam fixed to said support;

said intermediate member being journalled in said eccentric circular cam, said support being supported by at least one of said drive and driven members for rotation about said shaft axis.

DETAILED DESCRIPTION OF THE INVENTION

Figure 1:
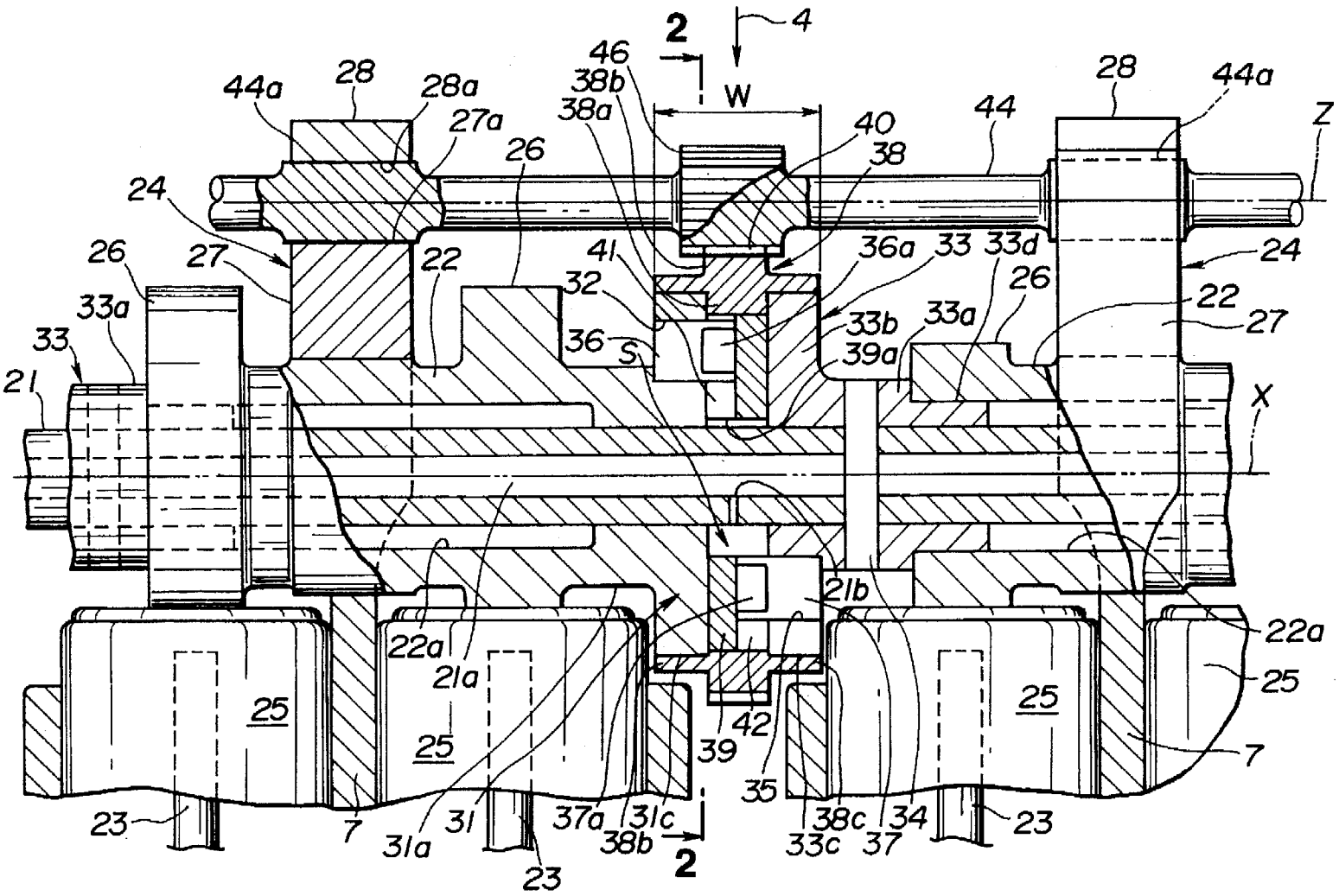
FIG. 1 is a fragmentary side view, partly broken away, of a phase changing mechanism installed as a part of a valve actuation system of a train of cylinder valves of an internal combustion engine.

Referring to the accompanying drawings, like reference numerals and characters are used throughout all of the Figures to denote like or similar parts for the sake of simplicity of description.

In FIG. 1, the reference numeral 7 indicates a portion of a cylinder head of a dual overhead camshaft internal combustion engine. The engine has four cylinders arranged in line. For each of the four cylinders, for cylinder valves are arranged. They can be divided into a first group of eight cylinder valves and a second group of eight cylinders valves. The cylinder valves belonging to the first group can be lifted against valve springs to perform intake phase of the corresponding cylinders, while the cylinder valves belonging to the second group can be lifted against valve springs to perform exhaust phase of the corresponding cylinders.

In the first embodiment shown in FIG. 1, the present invention is applied to the intake valves 23 although the invention may be equally applicable to the exhaust valves. The intake valves 23 have valve lifters 25, respectively. Instead of a single conventional camshaft, four hollow cams 22, only two being shown in FIG. 1, control the valve lifters 25. Each of the hollow cams 22 has two spaced cam lobes 26 cooperating with the two valve lifters 25 of the associated one of the cylinders. Extending through a central bore 22*a* of each of the hollow cams 22 is a driving shaft 21 which is rotatable about a shaft axis X by conventional means such as a sprocket and a chain. The hollow cams 22 are journalled in and thus rotatably supported by spaced cam bearings 24 which are secured to the cylinder head 7 and arranged in line one after another. Each of the cam bearings 24 includes a main bracket 27 cooperating with one of bearing surfaces formed on the cylinder head 7 and a sub bracket 28 on top of the main bracket 27, and two bolts 29 and 30 (see FIG. 2) extending through the sub bracket 28 and the main bracket 27. The main bracket 27 has a bearing surface 27*a* recessed from the top thereof, while the sub bracket 28 has a bearing surface 28*a* recessed from the bottom thereof. These bearing surfaces 27*a* and 28*a* cooperate with each other to form a bearing rotatably supporting a control rod 44 which is latter described.

The hollow cams 22 support the driving shaft 21 such that the hollow cams 22 angularly movable or rotatable relative to the driving shaft 21 about the shaft axis X. The detail as to how each of the hollow cams is held in concentric relation with the driving shaft 21 will become apparent as the discussion proceeds.

A plurality of, four in this embodiment, drive members 33 are rotatable with the diving shaft 21 and arranged to drive the hollow cams 22 although in FIG. 1, there are illustrated only two such drive members 33 journalled in the two hollow cams 22 from their left ends, viewing in FIG. 1. There are a plurality of, four in this embodiment, supports 38, although only one of such supports 38 is illustrated in FIG. 1. There are a plurality of, four in this embodiment, driven members 31 although only one of such driven members 31 is illustrated in FIG. 1.

Figure 2:
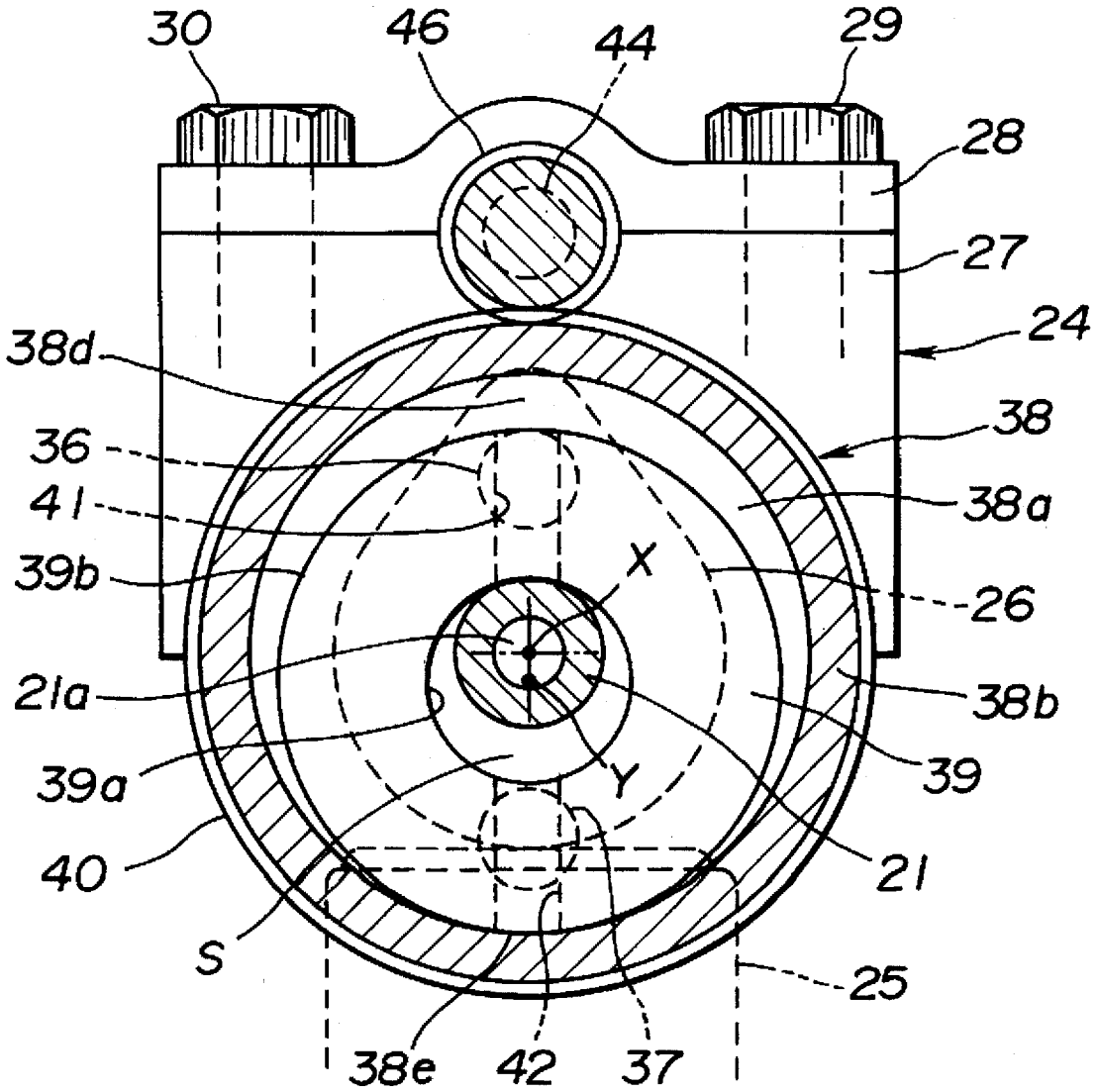
FIG. 2 a section taken through the line 2—2 of FIG. 1 showing the position of parts when a support assumes a zero degree position where a thickened portion of an eccentric circular cam is oriented upwardly viewing in FIG. 2 to produce an eccentricity between an axis of rotation of an intermediate member and an axis of rotation of a driving shaft.

As best seen in FIG. 2, the support 38 has fixed thereto an eccentric circular cam 38*a*. In this embodiment, the eccentric circular cam 38*a* is an integral part of and forms a part of a wheel 38*b* of the support 38. The eccentric circular cam 38*a* defines on its inner circumference a cylindrical bearing surface in which an intermediate member 39 is journalled. Viewing in FIG. 2, the intermediate member 39 is in the form of an annular disc and thus it may be called as an annular disc. Since the support 38 houses the annular disc for rotation about an axis Y thereof, it may be called as a disc housing.

Referring back to FIG. 1, the drive member 33 includes a sleeve 33*a* coupled with the driving shaft 21 and fixed thereto for unitary rotation owing to a cotter pin 34 passing diametrically through the sleeve 33*a* and the driving shaft 21. The sleeve 33*a* is long enough so that there occurs no path of hydraulic fluid through clearance between the driving shaft 21 and the sleeve 33*a*. The drive member 33 includes an integral drive disc 33*b* extending radially outwardly from the sleeve 33*a* and defining one end thereof. The drive disc 33*b* has a bearing surface on an outer circumferential wall 33*c* thereof. At a portion extending inwardly from the opposite end thereof, the sleeve 33*a* is reduced in diameter to form a cylindrical bearing surface 33*d*. The sleeve 33*a* is journalled in the adjacent hollow cam 22 with its reduced diameter portion inserted into the bore 22*a*.

The driven member 31 includes a sleeve 31*a* forming an integral part of the adjacent hollow cam 22 and an integral driven disc 31*b* extending radially outwardly from the sleeve 31*a* and defining one end of the sleeve 31*a*. The sleeve 31*a* slidably engage the driving shaft 21 and it is long enough so that there occurs no path of hydraulic fluid through clerance between the sleeve 31*a* and the driving shaft 21. The driven disc 31*b* has a bearing surface on an outer circumferential wall 31*c* thereof.

From the preceding description, it will be understood that, with the sleeve 33*a* of the drive member 33 inserted into the bore 22*a* and the sleeve 31*a* of the driven member 31 on the driving shaft 21, each of the hollow cams 22 is held in coaxial relation with the driving shaft 21.

The intermediate member 39 in the form of an annular disc has a central hole 39*a* which allows the driving shaft 21 to pass therethrough. The central hole is wide enough to allow movement of the annular disc 39 in a plane perpendicular to the shaft axis X without touching the outer surface of the driving shaft 21. Direction of eccentricity of the axis Y of the annular disc 39 with respect to the shaft axis X can be altered by rotating the support or disc housing 39 about the shaft axis X in the plane perpendicular to the shaft axis X. Thus, the annular disc 39, which is rotatably supported in the eccentric circular cam 38*a* of the wheel 38*b* of the support 38 for rotation about the axis Y thereof, can rotate eccentrically with respect to the shaft axis X.

The support 38 is rotatably supported by the drive disc 33*b* of the drive member 33 and has an axial sleeve 38*c* protruding from the wheel 38*b* toward the adjacent drive member 33 to rotatably receive therein the drive disc 33*b* of the drive member 33. Preferrably, the support 38 has a second axial sleeve 38*b* protruding from the wheel 38*b* toward the driven member 31 to rotatably receive therein the driven disc 31*b* of the driven member 31. In this manner, the support 38 is supported by the drive disc 33*b* of the drive member 33 only or in cooperation with the the driven disc 31*b* of the driven member 31 for rotation about the shaft axis X.

For transfer of torque from the drive member 33 to the intermediate member 39, a first coupling to couples the drive member 33 wish the intermediate member 39 at a first position spaced from the shaft axis X. For transfer of torque from the intermediate member 39 to the driven member 31, a second coupling couples the driven member 31 with the intermediate member 39 at a second position angularly spaced from the first position with respect to the shaft axis X. In this embodiment, the second position is angularly displaced from the first position through 180 degrees. The first coupling has a movable connection with the intermediate member 39 to permit variation in a distance of the first position from the axis Y of rotation of the intermediate member 39 during operation. The second coupling has a movable connection with the intermediate member 30 to permit variation in a distance of the second position from the axis Y of rotation of the intermediate member 39 during operation.

The first coupling includes a first radial groove 42 formed in that one face of the annular disc 39 which is opposed to the drive disc 33*b* of the drive member 33 and a first pin 37 journalled at one end in a pin receiving bore 35 which the drive disc 33*b* is formed with. The first pin 37 has the opposite end portion thereof defined by two opposite flat faces 37*a* slidably engaging in the radial groove 42. The second coupling includes a second radial groove 41 in the opposite face of the intermediate member 39 and a second pin 36 journalled at one end journalled in a pin receiving bore 32 which the driven disc 31*b* is formed with. The second pin 36 is has the opposite end portion thereof defined by two opposite flat faces 36*a* slidably engaging in the radial groove 41. As best seen in FIG. 2, the radial grooves 42 and 41 are angularly displaced one from the other about the aixs Y of rotation of the intermediate member 39 through 180 degrees, while the first and second pins 37 and 36 are spaced from the shaft axis X and angularly displaced one from the other about the shaft axis X through 180 degrees. During operation when the intermediate member 39 rotates eccentrically with respect to the shaft axis X, the first pin 37 moves along the radial groove 42 toward and away from the axis Y of rotation of the intermediate member 39, while the second pin 36 moves along the radial groove 41 away from and toward the axis Y of rotation of the intermediate member 39. In other words, the first coupling couples the drive member 33 with the intermediate member 39 at the first position where the first pin 37 is located and has the movable connection defined by the first pin 37 and the radial groove 42, while the second coupling couples the driven member 31 with the intermediate member 39 at the second position where the second pin 36 is located and has the movable connection defined by the second pin 36 and the radial groove 41.

Each of the radial grooves 42 and 41 communicates at a radially inner end thereof with the central hole 39*a* and is open at a radially outer end thereof within the outer circumferential surface of the intermediate member 39. The intermediate member 39 cooperates with the driving shaft 21, the drive disc 33*b* and the driven disc 31*b* to define within the central hole 39*a* a chamber S which serves as a reservoir for hydraulic fluid for lubrication. For supply of hydraulic fluid to the chamber S, the driving shaft 21 is formed with an axially extending lubrication passage 21*a* and a radial bore 21*b* communicating at a radially inner end thereof with the lubrication passage 21*a* and opening at a radially outer end thereof to the chamber S within the central hole 39*a*. The lubrication passage 21*a* is connected to an appropriate source of hydraulic fluid pressure for lubrication of the engine.

With the lubrication system described above, hydraulic fluid flows radially outwardly through the radial grooves 42 and 41 owing to centrifugal force during operation for lubrication of the interface between the pin 37 and the radial groove 42, the interface between the pin 36 and the radial groove 41, and the interface between the intermediate member 39 and the eccentric cvircular cam 38*a*.

Figure 8:
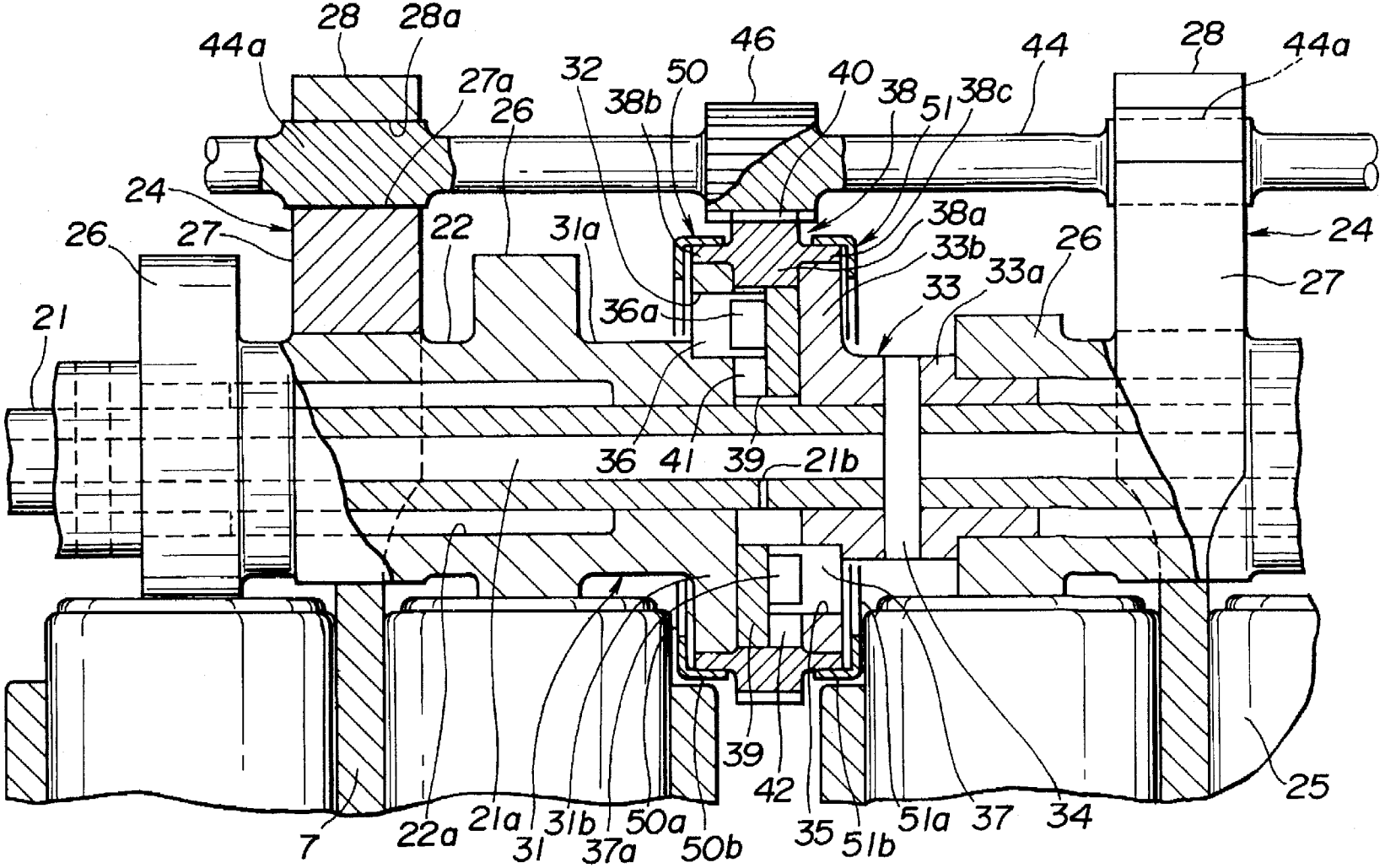
FIG. 8 is a similar view to FIG. 1 showing a second embodiment according to the present invention.

If desired, as shown in FIG. 8, a first trough 51 and a second trough 50 are provided for receiving the lubrication fluid leaked through clearance between the drive disc 33*b* and the axial sleeve 38*c* or through clearance between the driven disc 31*b* and the axial sleeve 38*b*. As shown in FIG. 8, the first trough 51 includes a cylindrical portion 51*b* receiving therein the axial sleeve 38*c* of the intermediate member 38 by press fit and an annular axial end 51*a* extending from the cylindrical portion 51*b* inwardly beyond an interface between the axial sleeve 38*c* and the drive disc 33*b*, while the second trough 50 includes a cylindrical portion 50*b* receiving therein the axial sleeve 38*b* of the intermediate member 38 by press fit and an annular axial end 50*a* extending from the cylindrical portion 50*b* inwardly beyond an interface between the axial sleeve 38*b* and the drive disc 33*b*. This arrangement provides improved lubrication performance.

Figure 3:
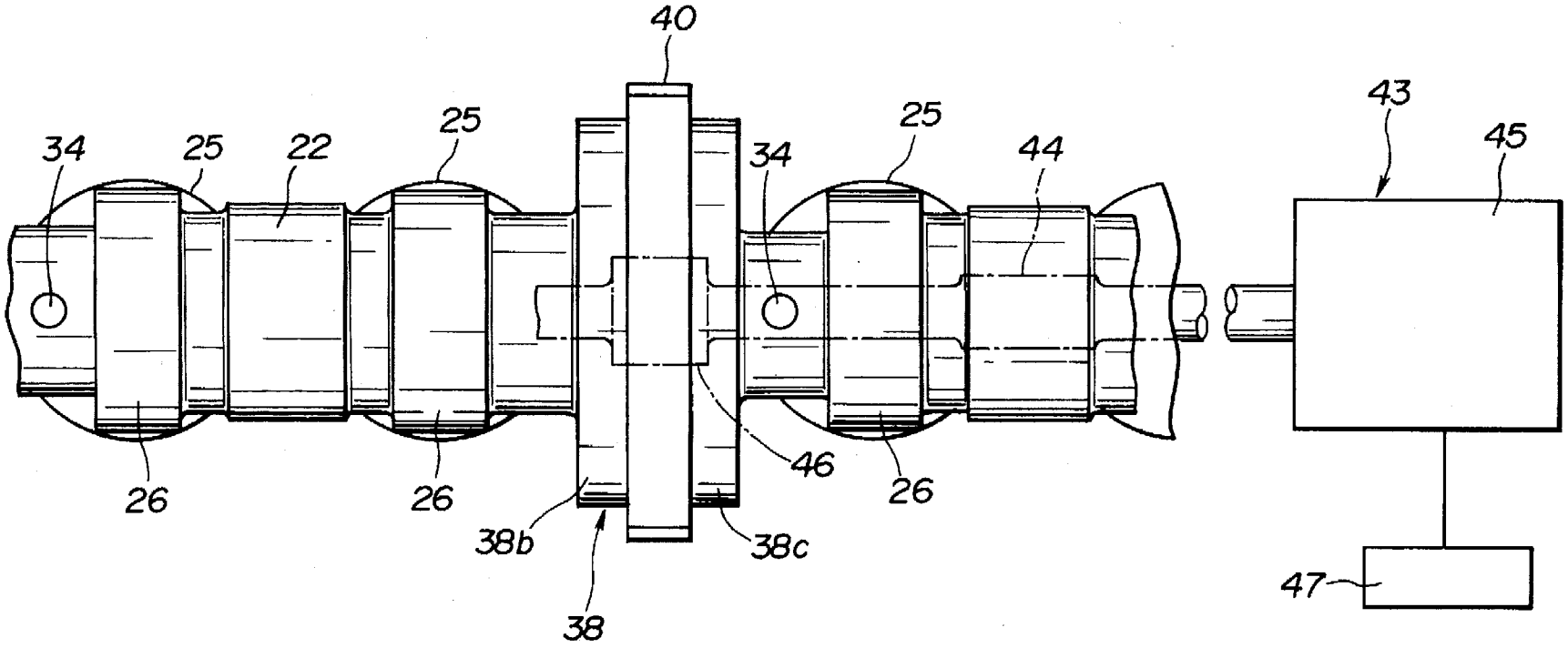
FIG. 3 is a fragmentary plan view of the phase changing mechanism.
Figure 4:
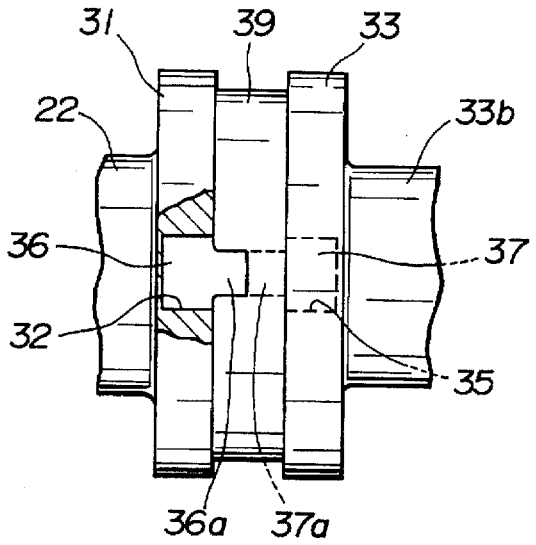
FIG. 4 is a fragmentary plan view viewing FIG. 1 in a direction of an arrow 4 with a control rod and a support removed and partly broken away to illustrate positional relationship between pins.
Figure 5:
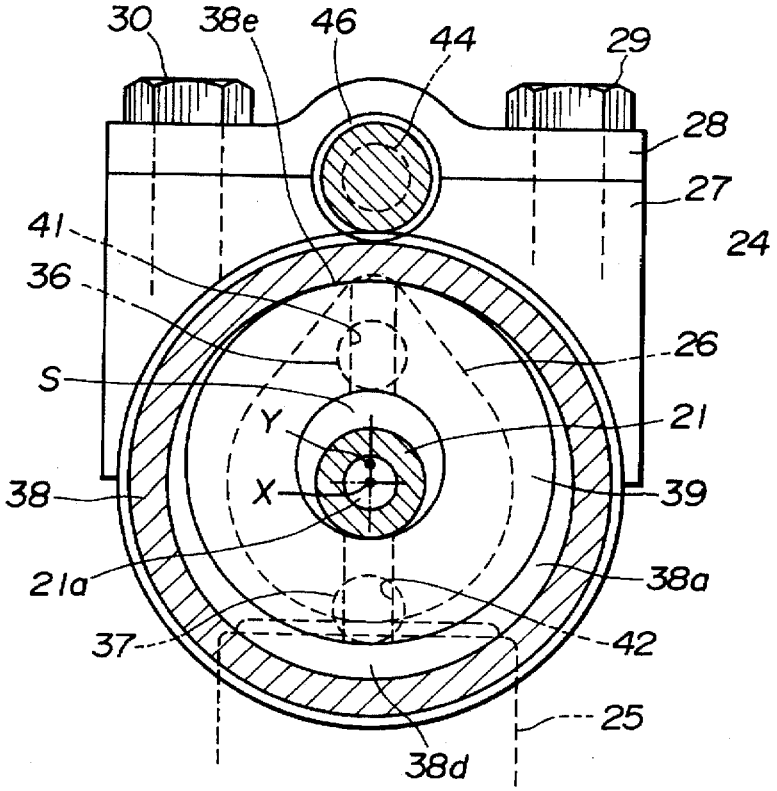
FIG. 5 is a similar view to FIG. 2 with the support angularly displaced through 180 degrees to assume a 180 degrees position where the thickened portion of the eccentric circular cam is oriented downwardly to produce an eccentricity between the axis of rotation of the intermediate member and the axis of rotation of the driving shaft.

For positioning the support 38 to the position as illustrated in FIG. 5 or to the position as illustrated in FIG. 2, the wheel 38*b* of the support is formed at its outer circumference with a gear 40 which a pinion 46 integral with a control rod 44 is in meshing engagement with. As shown in FIG. 1, the control rod 44 has axially spaced enlarged diameter portions 44*a* journalled in the cam bearings 24, respectively. In detail, each of the enlarged diameter portions 44*a* is disposed between two mating bearing surfaces 27*a* and 28*a* of the main and sub brackets 27 and 28. The control rod 44 is therefore rotatable about a control rod axis Z lying in parallel to the shaft axis X. As shown in FIG. 3, the control rod 44 is connected to an output of an actuator 43 including a stepping motor 45. The stepping motor 45 is connected with a controller 47. In response to an output of the controller 47, the stepping motor 45 turns by an angle corresponding to the number of steps instructed by the output of the controller 47, causing the control rod 44 and the pinion 46 to turn to position the support 38.

Referring to FIGS. 2, 5, 6(A), 6(B) and 6(C), the phase adjusting mechanism is further described.

In the position as illustrated in FIG. 5, there is produced an eccentricity of the axis Y of the intermediate member 39 with respect to the shaft axis X in an upward direction as viewed in FIG. 5. In this position, a distance between the first pin 37 of the drive member 33 and the axis Y is the maximum or the longest, while a distance between the second pin 36 of the driven member 31 is the minimum or the shortest. If, in FIG. 5, the intermediate member 38 has rotated about the axis Y through 180 degrees, the distance between the first pin 37 and the axis Y is the minimum or the shortest, while the distance between the second pin 36 of the driven member 31 is the maximum or the longest.

If the support 38 is rotated through 180 degrees from the position as illustrated in FIG. 5 to the position as illustrated in FIG. 2, the direction of the eccentricity is altered although the magnitude of the eccentricity remains unaltered.

In the position as illustrated in FIG. 2, there is produced the eccentricity in a downward direction as viewed in FIG. 5. In this position, the distance between the first pin 37 of the drive member 33 and the axis Y is the minimum or the shortest, while the distance between the second pin 36 of the driven member 31 is the maximum or the longest. If, in FIG. 2, the intermediate member 38 has rotated about the axis Y through 180 degrees, the distance between the first pin 37 and the axis Y is the maximum or the longest, while the distance between the second pin 36 of the driven member 31 is the minimum or the shortest.

Figures 6A, 6B, 6C:
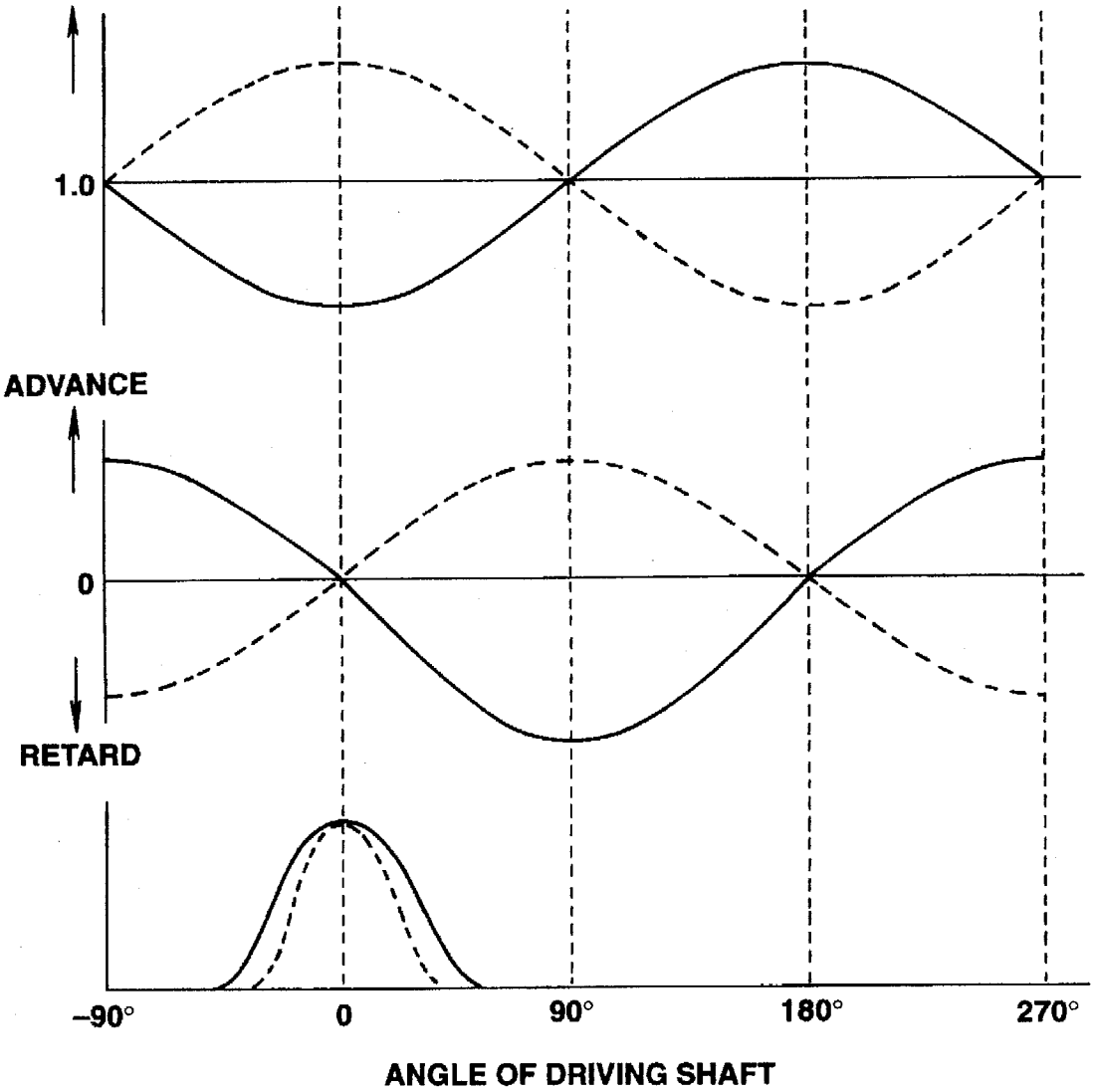
FIG. 6(A) shows in the broken line a speed ratio of a driven member (connected to a cam) to a drive member (connected to the driving shaft) when the support is at the 180 degrees position shown in FIG. 5 versus an angular position of the driving shaft, and in the fully drawn line the speed ratio when the support is at zero-degree position as shown in FIG. 2.
FIG. 6(B) shows in the broken line a phase difference between the cam to which the driven member is connected and the driving shaft to which the drive member is connected versus angular position of the driving shaft when the support is at 180 degrees position as shown in FIG. 5, and in the fully drawn line the phase difference when when the support is at zero degree position as shown in FIG. 2.
FIG. 6(C) shows in the broken line a valve lift dirgram versus angular position of the driving shaft when the support is at 180 degrees position as shown in FIG. 5, and in the fully drawn line the valve lift diagram when the support is at zero degree position as shown in FIG. 2.

Let us now assume that the support 38 is positioned as illustrated in FIG. 5 where the thickened portion 38*d* of the eccentric circular cam 38*a* is oriented downwardly, and the driving shaft 21 rotates clockwise (viewing in FIG. 5) at a constant speed. The angular speed of the intermediate member 39 is no longer equal to that of the driving shaft 21. The dotted line shown in FIG. 6(A) illustrates the variation of the angular speed of the hollow cam 22. The dotted line shown in FIG. 6(B) illustrates the variation of phase of the hollow cam 22. From this, it will be noted that the hollow cam 22 is retarded during the acceleration phase of the hollow cam 22, while advanced during the deceleration phase of the hollow cam 22. Since the top of each of the cam lobes 26 of the hollow cam 22 is oriented upwardly at the angular position of the intermediate member 39 as illustrated in FIG. 5, the valve duration becomes minimum as illustrated by the dotted line drawn valve lift diagram in FIG. 6(C).

Nextly, let us now assume that the support 38 is positioned as illustrated in FIG. 2 where the thickened portion 38*d* of the eccentric circular cam 38*a* is oriented upwardly, and the driving shaft 21 rotates clockwise (viewing in FIG. 2) at a constant speed. The angular speed of the intermediate member 39 will be no logger equal to that of the driving 30 shaft 21. The fully darwn line shown in FIG. 6(A) illustrates the variation of the angular speed of the hollow cam 22. The fully drawn line shown in FIG. 6(B) illustrates the variation of phase of the hollow cam 22. From this, it will be noted that the hollow cam 22 is retarded during the acceleration phase of the hollow cam 22, while advanced during the deceleration phase of the hollow cam 22. Since the top of each of the cam lobes 26 of the hollow cam 22 is oriented upwardly at the angular position of the intermediate member 39 as illustrated In FIG. 2, the valve duration becomes maximum as illustrated by the fully line drawn valve lift diagram in FIG. 6(C).

Figure 7:
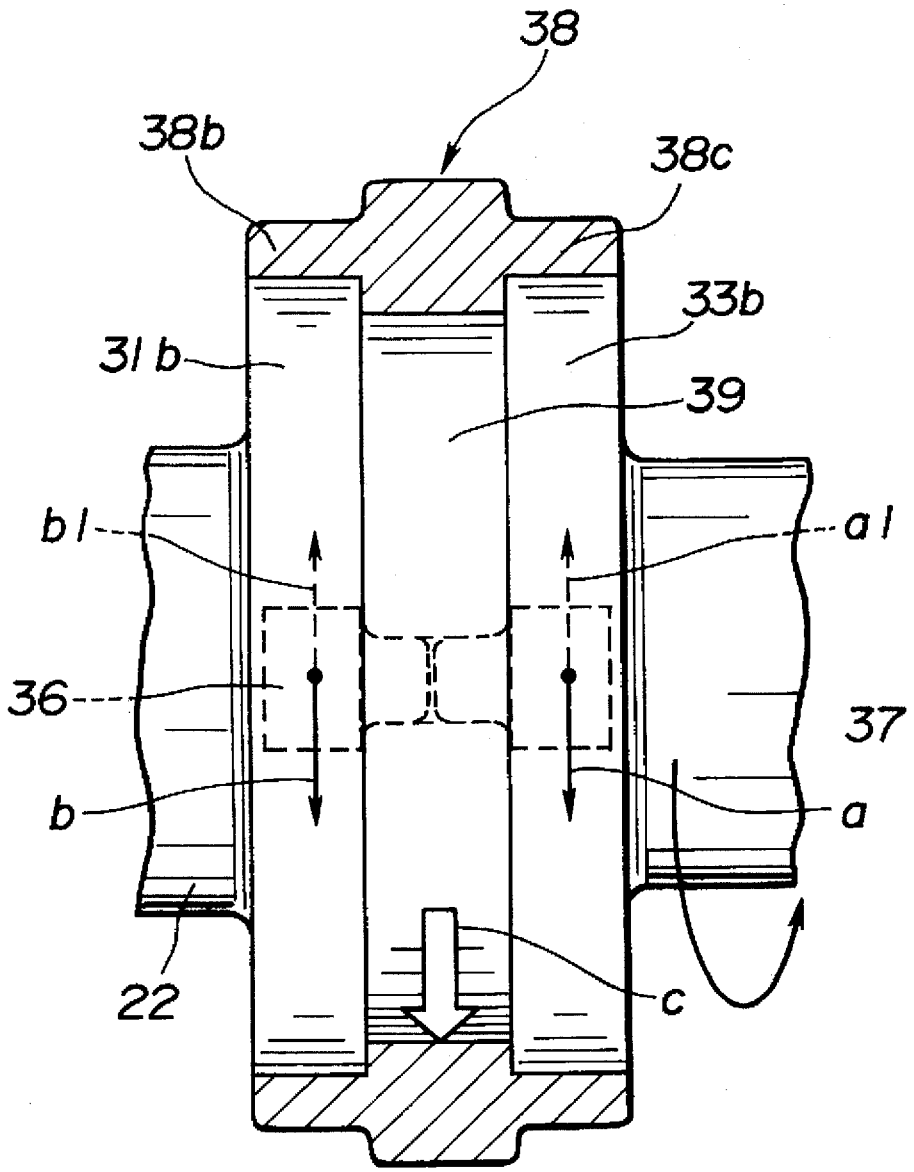
FIG. 7 is an enlarged fragmentary view viewing FIG. 1 in the direction of arrow 4 with the control rod removed and the support partially broken away.

FIG. 7 illustrates forces which the drive disc 33*b* of the driving shaft 21, the intemediate member 39, the support 38, and the driven disc 31*b* are subjected to during rotation of the driving shaft 21. In FIG. 7, the reference character a represents a force applied to the intermediate member 39 by the drive disc 33*b* and the pin 37, and the reference character a1 is a reaction force which the drive disc 33*b* is subjected to. The magnitude of the force a1 is equal to that of the force a. This force a1 causes bending stress on the driving shaft 21 during rotation thereof. The reference numeral b represents a reaction force which the intermediate member 39 receives from the pin 36, the reference character b1 is a force applied to the intermediate member 39 from the driven disc 31*b* and the pin 36 owing to the valve springs, and the reference character c represents a force which the intermediate member 39 is subjected to. The magnitude of the force c is a sum of the forces a and b (c=a+b). The support 38 is loaded radially outwardly with the force c. Since the support 38 is supported by the drive and driven discs 33*b* and 31*b*, the force c is applied to the drive and driven discs. Since the direction of force c is opposed to the before-mentioned reaction force a1, the reaction force a1 is eliminated or at least reduced. Thus, bending stress otherwise would be applied to the driving shaft 21 is eliminated. Thus, rotation of the driving shaft 21 without any bending stress is accomplished.

FIG. 8 illustrates the second embodiment whic, as previously described, differens from the first embodiment only in the provision of the first and second troughs 51 and 50.

Figure 9:
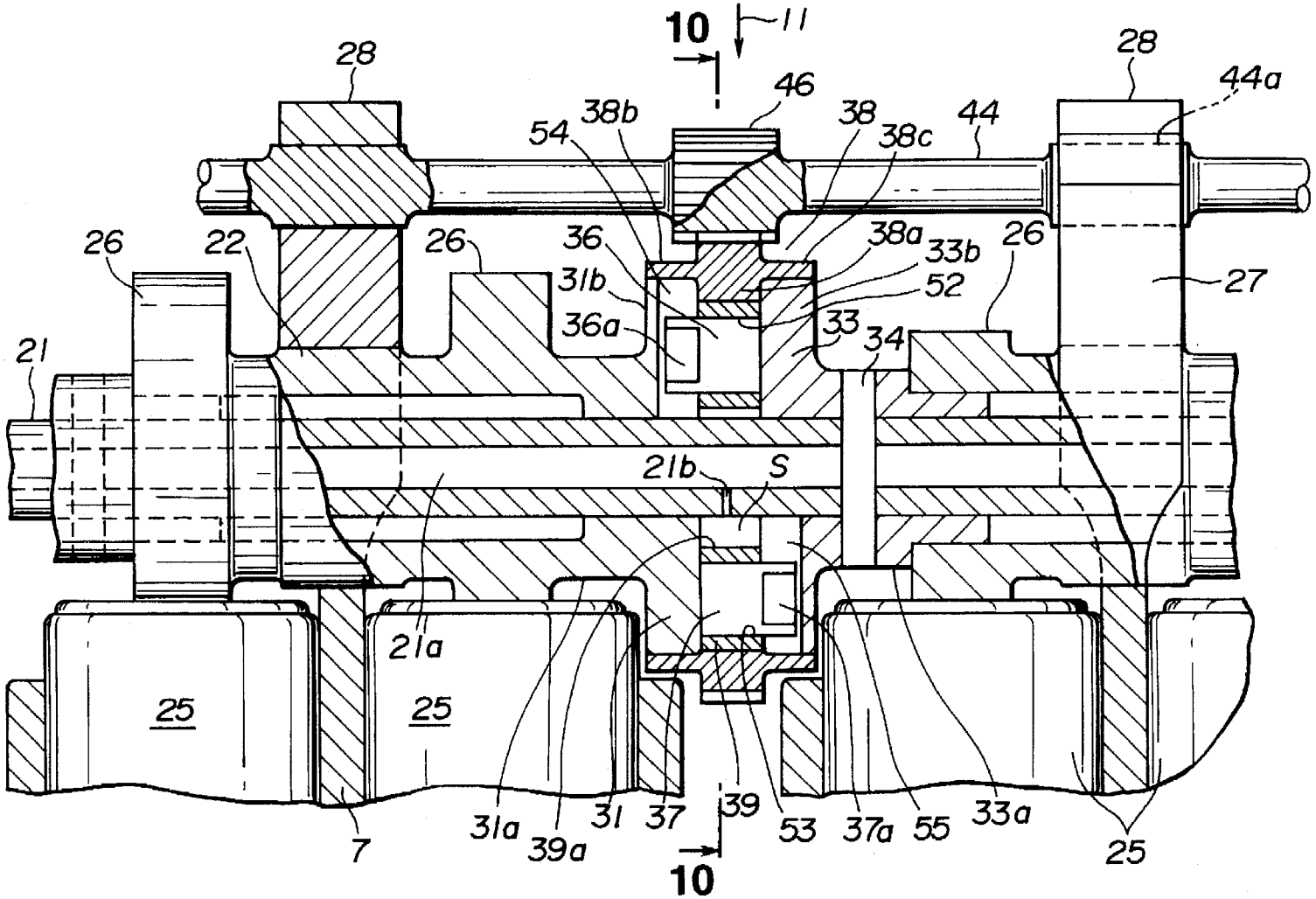
FIG. 9 is a similar view to FIG. 8 showing a third embodiment according to the present invention.
Figure 10:
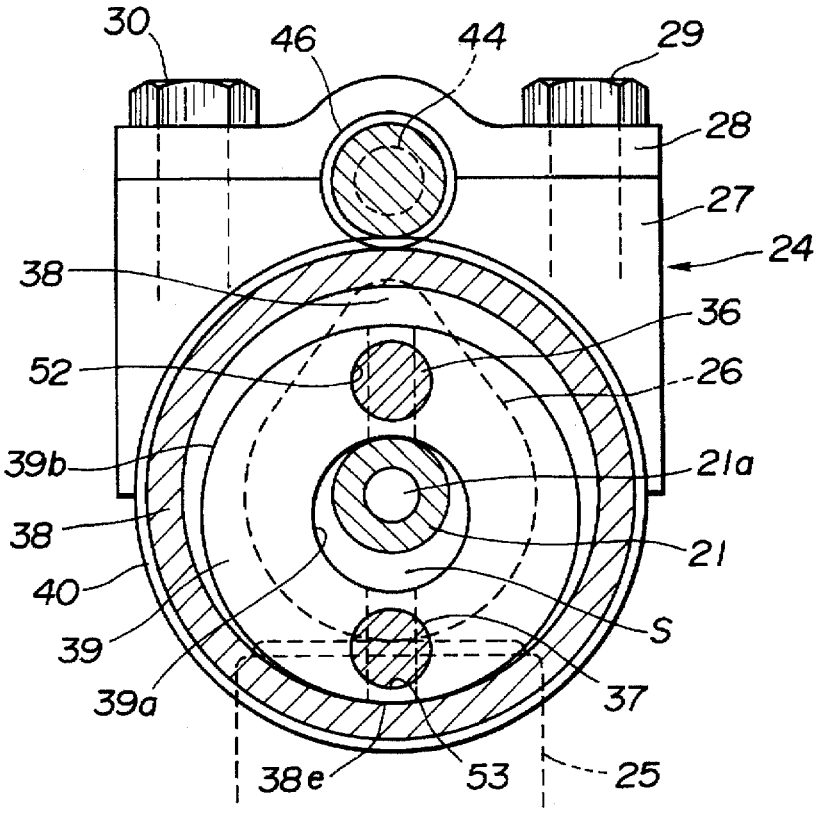
FIG. 10 is a section taken through the line 10—10 of FIG. 9.
Figure 11:
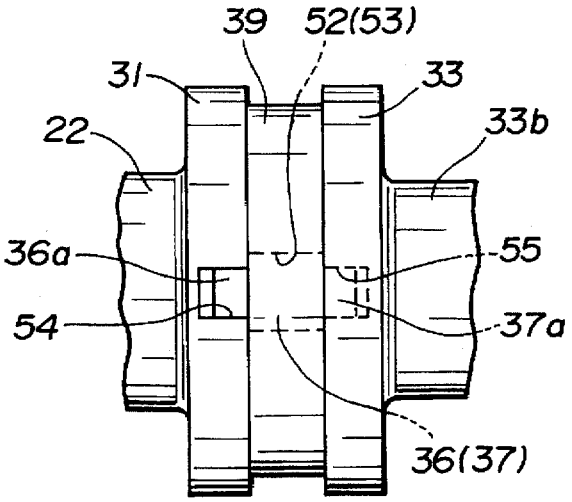
FIG. 11 is a fragmentary plan view viewing FIG. 9 in a direction of an arrow 11 with a control rod and a support removed and partly broken away to illustrate positional relationship between pins.

FIG. 9 illustrates the third embodiment. This embodiment is substantially the same as the first embodiment except the provision of modified first and second couplings. The modified first coupling includes a first radial groove 55 in a drive disc 33*b* of a drive member 33, and a first pin 37 journalled at one end thereof in a pin receiving hole 53 of an intermediate member 39 in the form of an annular disc and at opposite end thereof slidably engaged in the first radial groove 55. The modified second coupling includes a second radial groove 54 in a driven disc 31*b* of a driven member 31, and a second pin 36 journalled at one end thereof in a pin receiving hole 52 of the intermediate member 39 and at the opposite end thereof engaged in the second radial groove 54. The first and second radial grooves 55 and 54 communicate at radially inner ends thereof with a central hole 39*a*. At their radially outer ends, the radial grooves 55 and 54 are open to inner walls of first and second axial sleeves 38*c* and 38*b* of a support 38.

Referring to FIGS. 12 through 18, the fourth embodiment is described. This embodiment is substantially the same the first embodiment except that a support 38 is supported by a drive disc 33*b* of a drive member 33 and is not supported by a driven disc 31*a* of a driven member 31 and further modified first and second couplings are used.

Figure 12:
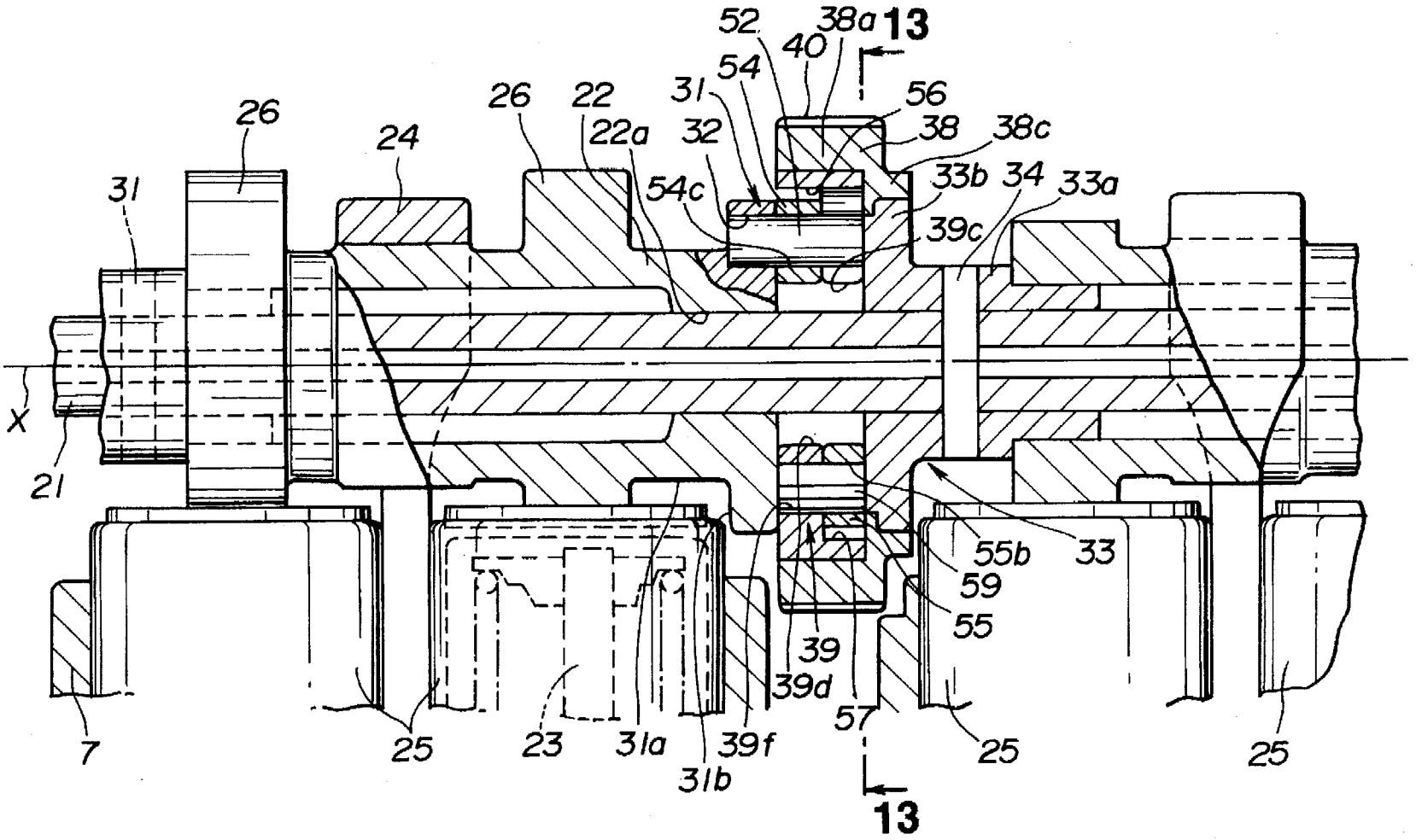
FIG. 12 is a similar view to FIG. 9 partly broken away to show a section taken though the line 12—12 of FIG. 13, showing a fourth embodiment according to the present invention.
Figure 13:
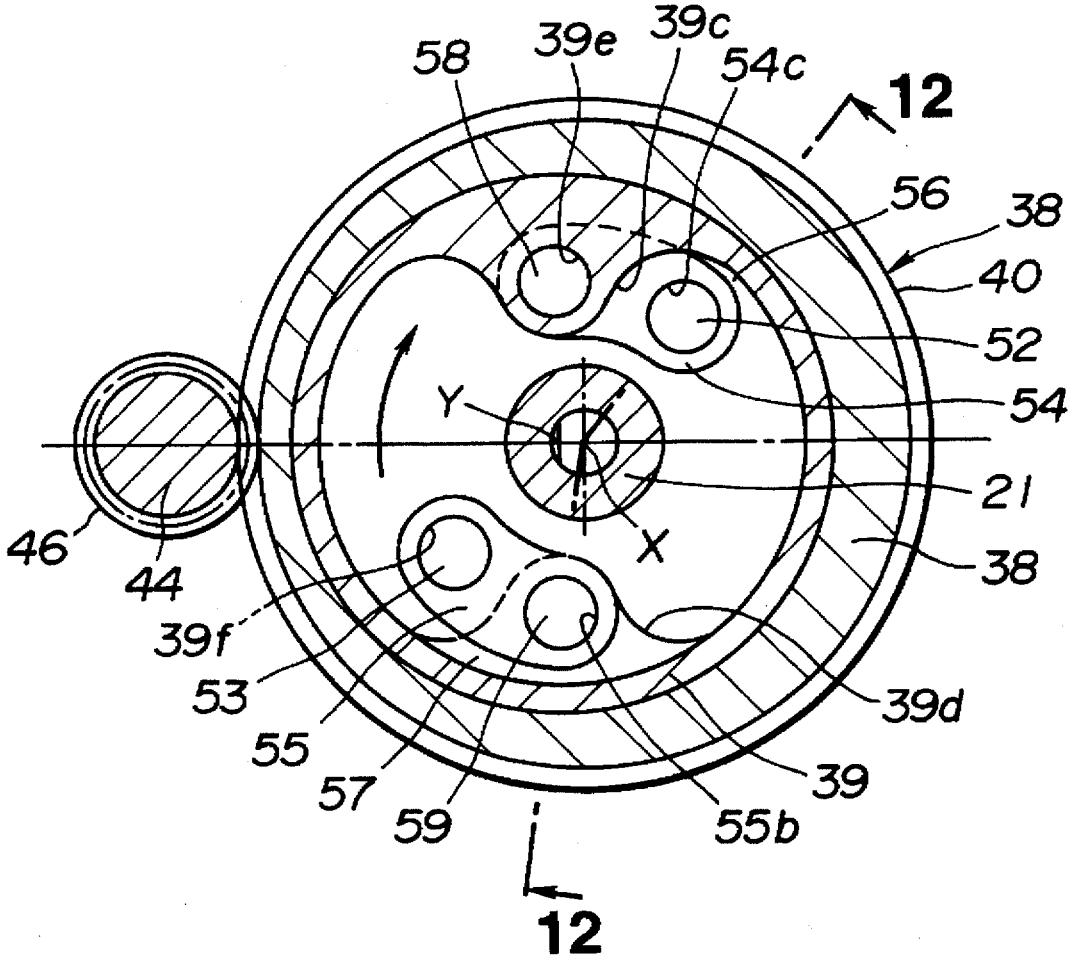
FIG. 13 is a section taken through the line 13—13 of FIG. 12, showing the position of parts when a support assumes a zero degree position where a thickened portion of an eccentric circular cam is oriented to the right viewing in FIG. 13 to produce an eccentricity between an axis or rotation of an intermediate member and an axis of rotation of a driving shaft.
Figure 14:
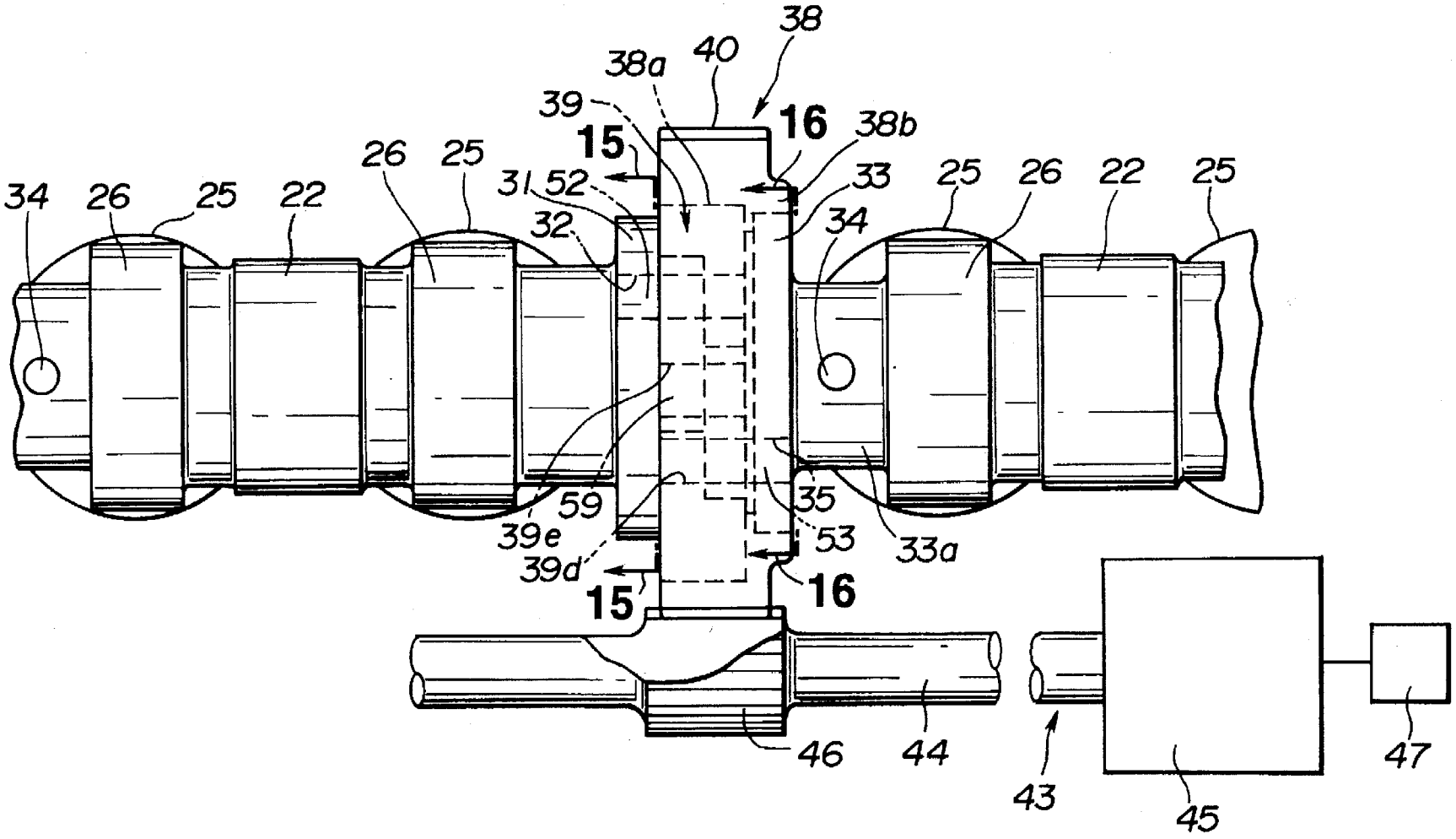
FIG. 14 is a fragmentary plan view of the forth embodiment of the phase changing mechanism shown in FIG. 12.
Figure 15:
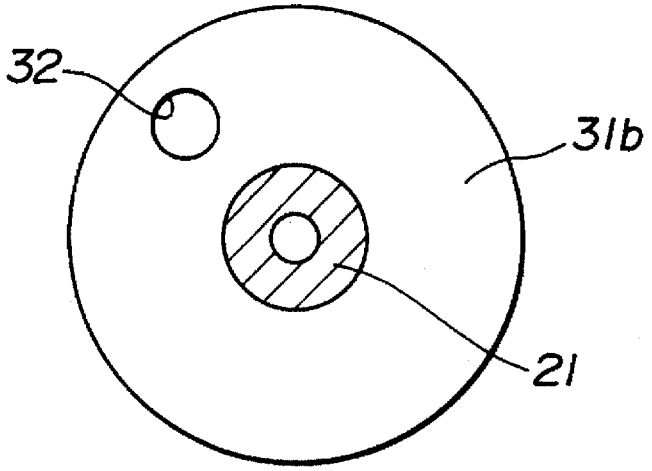
FIG. 15 is a section taken through the line 15—15 of FIG. 14.
Figure 16:
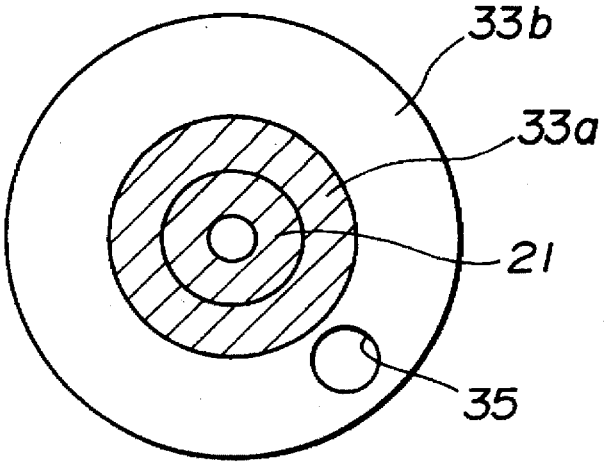
FIG. 16 is a section taken through the line 16—16 of FIG. 14.

As readily seem from FIGS. 12, an intermediate member 39 is in the form of a ring with a bracket 39*d* formed with a pin receiving hole 39*f* (see FIG. 12) and a second bracket 39*c* formed with a pin receiving hole 39*e* (see FIG. 13). The first and second brackets 39*d* and 39*c* are generally diamtrically opposed to each other with respect to an axis Y of rotation of the intermediate member 39. More specifically the pin receiving holes 39F (see FIG. 12) and the pin receiving hole 39*e* (see FIG. 13) are spaced from the axis Y and angularly displaced through 180 degrees with respect to the asix Y. A first lever 55 is pivotalled connected at one end to the first bracket 39*d* by means of a pin 59 which passes through a hole 55*b* of the lever 55 and the pin receiving hole 39*f* of the first bracket 39*d*. A second lever 54 is pivotally connected at one end to the second bracket 39*c* by means of a pin 58 which passes through a hole (not shown) of the lever 54 and the pin receiving hole 39*e* of the second bracket 39*c*. The first and second levers 55 and 54 are pivotally connected at the opposite ends thereof to a drive disc 33*b* of a drive member 33 and to a driven disc 31*b* of a driven member 31. Specifically, a first relatively long pin 53 is journalled at one end thereof in a pin receiving hole 35 with which the drive disc 33*b* is formed (see FIG. 16) and a second relatively long pin 52 is journalled at one end thereof in a pin receiving hole 32 with which a driven disc 31*b* of a driven member 31 is formed (see FIG. 15). The pin receiving hole 32 is angularly displaced from the pin receiving hole 35 with respect to a shaft axis X which a driving shaft 21 rotates about. The first relatively long pin 53 passes through a hole 53 formed adjacent to the opposite end of the first lever 55 and abuts at the opposite end against the driven disc 31*b* of the driven member 31. The second relatively long pin 52 passes through a hole 54 formed adjacent the opposite end of the second lever 54 and abuts at the opposite end thereof against the drive disc 33*b* of the drive member 33.

Figure 17:
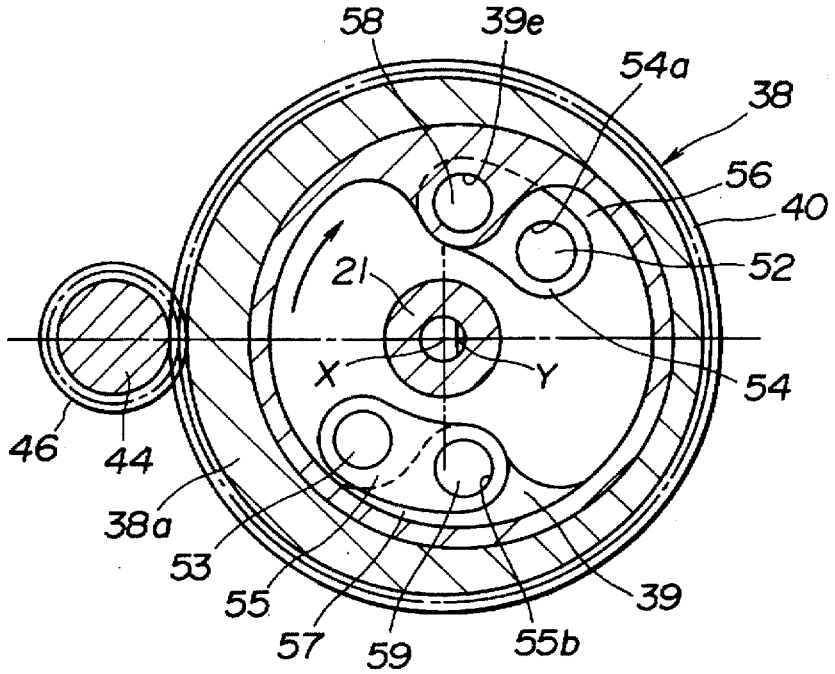
FIG. 17 is a similar view to FIG. 13 with the support angularly displaced through 180 degrees assume a 180 degrees position where the thickened portion of the eccentric circular cam is oriented to the left viewing in FIG. 17 to produce an eccentricity between the axis of rotation of the intermediate member and the axis of rotation of the driving shaft.
Figure 18:
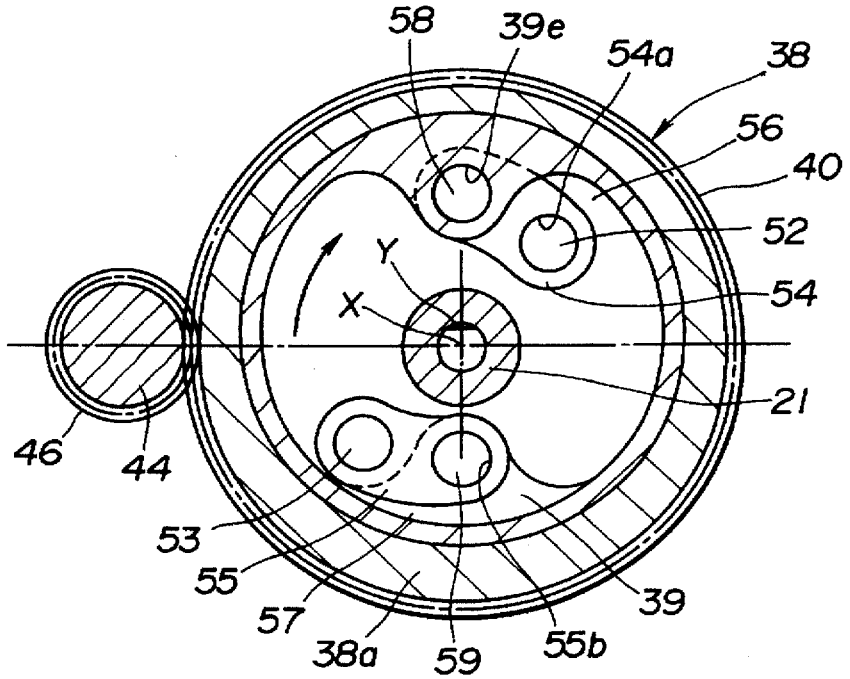
FIG. 18 is a similar view to FIG. 13 with the support angularly displaced through 90 degrees to assume a 90 degrees position where the thickened portion of the eccentric circular cam is oriented downwardly viewing in FIG. 18 to produce an eccentricity between the axis of rotation of the intermediate member and the axis of rotation of the driving shaft.

Three representative positions of the support 38 are illustrated in FIGS. 13, 17 and 18. In FIG. 13 position, a thickened portion of an eccentric circular cam 38*a* of the support 38 is oriented to the right and the axis Y of the intermediate member 39 is is displaced to the left from the shaft axis X (viewing in FIG. 18). In FIG. 18 position, the thickened portion of the eccentric circular cam 38*a* is oriented downwardly and the axis Y is displaced upwardly from the shaft axis X (viewing in FIG. 18). In FIG. 17 position, the thickened portion of the eccentric circular cam 38*a* is oriented to the left and the axis Y of the intermediate member 39 is is displaced to the right from the shaft axuis X (viewing in FIG. 17). In these Figures, the direction of rotation of the driving shaft 21 clockwise as indicated by an arrow.

During eccentric rotation of the intermediate member 39, the the first and second lever 55 and 54 pivots about the pins 59 and 58, respectively, to allow movable cvonnection at the relatively long first and second pins 53 and 52 to very their distances from the asix Y.

From the preceding description, it will be understood that, in the fourth embodiment, the first coupling includes the first lever 55 pivotally connected at one end thereof to the intermediate member 39 at the first bracket 39*d* thereof and at the opposite end thereof to the drive disc 33*b* of the drive member 33 by means of the first relatively long pin 53, and the second coupling includes the second lever 54 pivotally connected at one end thereof to the intermediate member 39 at the second bracket 39*c* thereof and at the opposite end thereof to the driven disc 31*b* of the drive member 31 by means of the second relatively long pin 53.

What is claimed is:

1. A phase changing mechanism comprising:

a driving shaft rotatable about a shaft axis;

a cam rotatable relative to said driving shaft;

a drive member rotatable with said driving shaft;

a driven member rotatable with said cams a support;

an intermediate member supported in said support for rotation about an axis thereof;

a first coupling coupling said drive member with said intermediate member at a first position spaced from said shaft axis;

a second coupling coupling said driven member with said intermediate member at a second position angularly spaced from said first position with respect to said shaft axis;

said first coupling having a movable connection with said intermediate member to permit variation in a distance of said first position from said axis of rotation of said intermediate member during operation, said second coupling having a movable connection with said intermediate member to permit variation in a distance of said second position from said axis of rotation of said intermediate member during operation, an eccentric circular cam fixed to said support;

said intermediate member being journalled in said eccentric circular cam, said support being supported by at least one of said drive and driven members for rotation about said shaft axis.

2. A phase changing mechanism as claimed in claim 1, wherein said support includes a wheel including said eccentric circular cam, a first axial sleeve protruding from said wheel toward said drive member, and wherein said drive member is rotatably received in said first axial sleeve for supporting said support.

3. A phase changing mechanism as claimed in claim 2, wherein said support includes a second axial sleeve protruding from said wheel toward said driven member, and wherein said driven member is rotatably received in said second axial sleeve for supporting said support.

4. A phase changing mechanism as claimed in claim 3, wherein said wheel of said support is formed at an outer circumference with a gear.

5. A phase changing mechanism as claimed in claim 4, further comprising:

a control rod rotatable about a control rod axis lying in parallel to said shaft axis, said control rod having a pinion in meshing engagement with said gear; and an actuator for actuation of said control rod.

6. A phase changing mechanism as claimed in claim 5, wherein said cam is hollowed for allowing said driving shaft to pass therethrough, and wherein said cam is integrated at one end thereof with said driven member.

7. A phase changing mechanism as claimed in claim 6, including a cam bearing for said cam to be journalled therein.

8. A phase changing mechanism as claimed in claim 7, wherein said control rod is journalled in said cam bearing.

9. A phase changing mechanism as claimed in claim 1, wherein said intermediate member is in the form of an annular disc having a central hole which allows said driving shaft to pass therethrough, and wherein said central hole is wide to allow movement of said annular disc in a plane perpendicular to the shaft axis without touching said driving shaft.

10. A phase changing mechanism as claimed in claim 9, wherein said first coupling includes a first radial groove in one face of said annular disc, and a first pin journalled at one end thereof in said drive member end at opposite end thereof slidably engaged in said first radial groove, and wherein said second coupling includes a second radial groove in the opposite face of said annular disc, and a second pin journalled and one end thereof in said second radial groove and at the opposite end thereof engaged in said second radial groove.

11. A phase changing mechanism as claimed in claim 10, wherein each of said first and second radial grooves communicates at a radially inner end thereof with said central hole.

12. A phase changing mechanism as claimed in claim 11, wherein said driving shaft is formed with a lubrication passage and a radial bore communicating at a radially inner end thereof with said lubrication passage and opening at a radially outer end thereof to said central hole.

13. A phase changing mechanism as claimed in claim 3, wherein said intermediate member is in the form of an annular disc having a central hole which allows said driving shaft to pass therethrough, and wherein said central hole is wide enough to allow movement of said annular disc in a plane perpendicular to the shaft axis without touching said driving shaft.

14. A phase changing mechanism as claimed in claim 13, wherein said first coupling includes a first radial groove in one face of said annular disc, and a first pin journalled at one end thereof in said drive member and at opposite end thereof slidably engaged in said first radial groove, and wherein said second coupling includes a second radial groove in the opposite face of said annular disc, and a second pin journalled at one end thereof in said second radial groove and at the opposite end thereof engaged in said second radial groove.

15. A phase changing mechanism as claimed in claim 14, wherein each of said first and second radial grooves communicates at a radially inner end thereof with said central hole.

16. A phase changing mechanism as claimed in claim 15, wherein said driving shaft is formed with a lubrication passage and a radial bore communicating at a radially inner end thereof with said lubrication passage and opening at a radially outer end thereof to said central hole.

17. A phase changing mechanism as claimed in claim 16, wherein each of said first and second radial grooves is open at a radially outer end thereof within an outer circumferential surface of said annular disc.

18. A phase changing mechanism as claimed in claim 17, further comprising a first trough which includes a cylindrical portion receiving therein said first axial sleeve by press fit and an annular axial end extending from said cylindrical portion inwardly beyond an interface between said drive member and said first axial sleeve.

19. A phase changing mechanism as claimed in claim 18, further comprising a second trough which includes a cylindrical portion receiving therein said second axial sleeve by press fit and an annular axial end extending from said cylindrical portion of said second trough inwardly beyond an interface between said driven member and said second axial sleeve.

20. A phase changing mechanism as claimed in claim 13, wherein said first coupling includes a first radial groove in said drive member, and a first pin journalled at one end thereof in said annular disc and at the opposite end thereof slidably engaged in said first radial groove, and wherein said second coupling includes a second radial groove in said driven member, and a second pin journalled at one end thereof in said annular disc and at the opposite end thereof slidably engaged in said second radial groove.

21. A phase changing mechanism as claimed in claim 20, wherein each of said first and second radial grooves communicates at a radially inner end portion thereof with said central hole.

22. A phase changing mechanism as claimed in claim 21, wherein said driving shaft is formed with a lubrication passage and a radial bore communicating at a radially inner end thereof with said lubrication passage and opening at a radially outer end thereof to said central hole.

23. A phase changing mechanism as claimed in claim 2, wherein said first coupling includes a first lever pivotally connected at one end thereof to said intermediate member and at the opposite end thereof to said drive member.

24. A phase changing mechanism as claimed in claim 23, wherein said second coupling includes a second lever pivotally connected at one end thereof to said intermediate member and at the opposite end thereof to said driven member.

* * * * *